United States Patent [19]

Husby et al.

[11] 4,339,789

[45] Jul. 13, 1982

[54] FLOOD LIGHT AIMING METHOD

[75] Inventors: Donald E. Husby; Jerry L. Ewing; William H. Johnson, all of Vicksburg, Miss.

[73] Assignee: Westinghouse Electric Corp., Pittsburgh, Pa.

[21] Appl. No.: 171,063

[22] Filed: Jul. 22, 1980

[51] Int. Cl.[3] ..... F21K 7/00

[52] U.S. Cl. ..... 362/259; 362/285; 362/296; 362/322; 362/341

[58] Field of Search ..... 362/259, 285, 296, 322, 362/341

[56] References Cited

U.S. PATENT DOCUMENTS

| | | | |
|---|---|---|---|
| 3,305,678 | 2/1967 | Neely | 362/252 |
| 4,160,285 | 7/1979 | Shibla | 362/432 |

*Primary Examiner*—Stephen J. Lechert, Jr.

*Attorney, Agent, or Firm*—B. R. Studebaker

[57] ABSTRACT

A method for quickly, efficiently and accurately aiming a flood light at a preselected location which involves directing or redirecting the collimated radiative output of a low power laser source at a preselected location. The laser output may be aimed at a mirror on the flood light face and reflected directly back to the preselected location or the laser can be temporarily mounted to the flood light and the laser output directed parallel to the flood light beam axis at said preselected location.

7 Claims, 3 Drawing Figures

FLOOD LIGHT AIMING METHOD

BACKGROUND OF THE INVENTION

This invention relates generally to a novel method for accurately aiming flood lights and more particularly to the accurate aiming of flood lights for sports facilities.

The lighting of sports facilities such as football, baseball, soccer, softball, and other athletic facilities is at present a semi-sophisticated art. Lighting engineers are able, through mathematical computations, to determine the number of flood lights and where the flood lights are to be aimed on the playing surface with a substantial degree of accuracy in order to provide optimum uniform lighting for the various different areas of the playing surface. Until now, aiming of the flood lights has been substantially a trial and error precedure. One method that has been applied in the past has been for the application engineer to determine the angular relationship of the flood light based upon its position with respect to the field and by employing angular markings, generally in 15° steps preset the mounting angle for the various flood lights of the system. This method is very crude and very large tolerances must be accommodated. This method in most instances requires substantial readjustment on a trial and error basis to get the proper foot candle levels at the various areas of the field.

Another method known as the "rifle site" method has been employed in many variations but basically the aiming of the flood light is determined by a line of site parallel to the beam axis of the flood light. In employing this method, the application engineer or lighting designer determines the particular locations on the plane surface at which each individual flood light should be aimed. These are identified as "pie plate" locations primarily because pie plates were originally used as targets. A crude site is mounted to the luminaire and is visually aimed, much like a rifle, at the pie plate location to provide, hopefully, accurate aiming of the flood light at the "pie plate" location. This method also incorporates parts and procedures which introduce large tolerances so far as the "aimed" location with reference to the "pie plate" is concerned and on exact means of checking has, until now, been available.

SUMMARY OF THE INVENTION

Lighting designers and application engineers have, for many years, been able to accurately determine how many flood lights should be employed to adequately light a sports facility and have also been able to determine theoretically exactly where, on the plane surface of the playing field, the beam axis of those flood lights should be aimed. With the advent of the present invention those flood lights can now be quickly, efficiently and accurately aimed at the location selected by the engineer or designer.

In accordance with the present invention, a flood light is aimed at a preselected location by directing the collimated radiative output of a laser from a flood light, adjustably aiming the flood light to cause the directed laser output to impinge on a target at a preselected location and fixing the flood light in a position to remain aimed at said preselected location. In one form of the invention the laser is temporarily mounted to the flood light and the axis of the collimated radiative output of the laser is aligned parallel to the beam axis of the flood light. In another, and more preferable, embodiment a mirror is mounted to the lens of the flood light perpendicular to the beam axis and the collimated radiative output of the laser is directed from a spot adjacent the preselected location at which the flood light beam is to be aimed and the laser beam then directed from the flood light by reflection from the mirror back to said preselected location. The mirror employed on the flood light is preferably matched to the laser color for optimum reflectance and a target is placed at the predetermined location to enhance the perception of the impingement of the laser output at that predetermined location. For example a gold mirror is preferred for reflecting certain laser beams.

BRIEF DESCRIPTION OF THE DRAWINGS

Many of the attended advantages of the present invention will become more readily apparent and better understood as the following detailed description is considered in connection with the accompanying drawings in which.

DESCRIPTION OF THE PREFERRED EMBODIMENT

Figure 4:
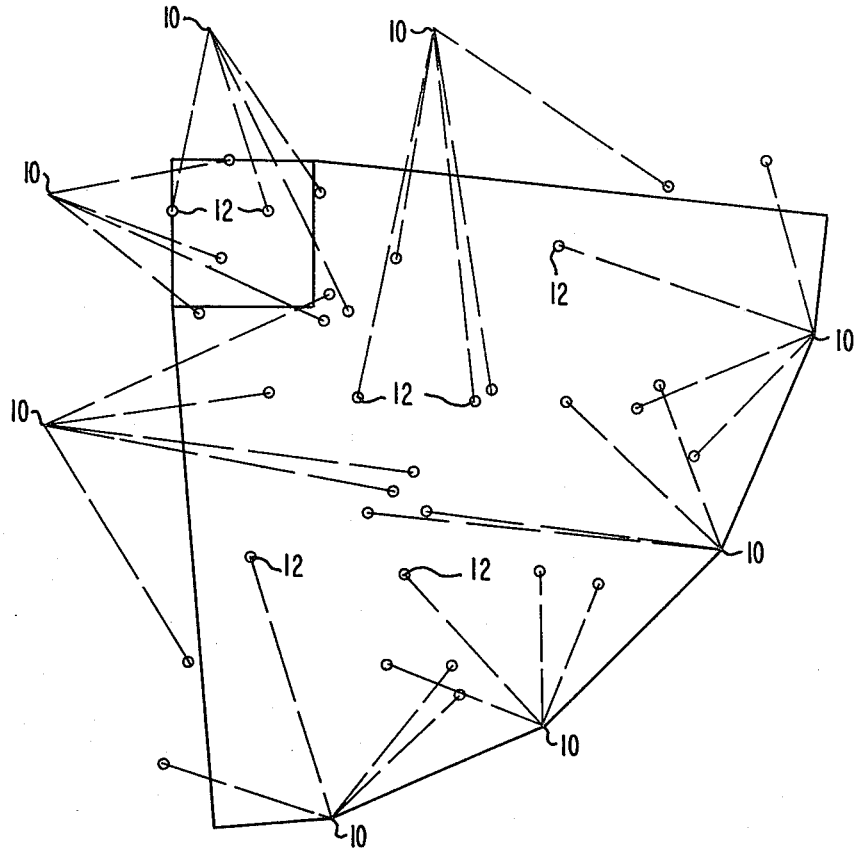
FIG. 4 is a typical schematic aiming diagram for lighting a typical softball field.

Referring now in detail to the drawings, wherein like reference characters represent like parts throughout the several views, there is illustrated in FIG. 4 a typical lighting schematic diagram for the efficient lighting of a typical softball field. The application engineer or lighting designer has determined in this instance that for this level of athletic participation adequate lighting can be provided by employing eight poles, 45 feet high which carry a total of thirty-four 1500 watt metal halide flood lights. Each of the poles 10 have been determined to require either four or five of the flood lights and the precise location for aiming the beam axis of the respective flood lights are designated as "pie plate" locations 12 on the plane surface of the playing field.

Figure 1:
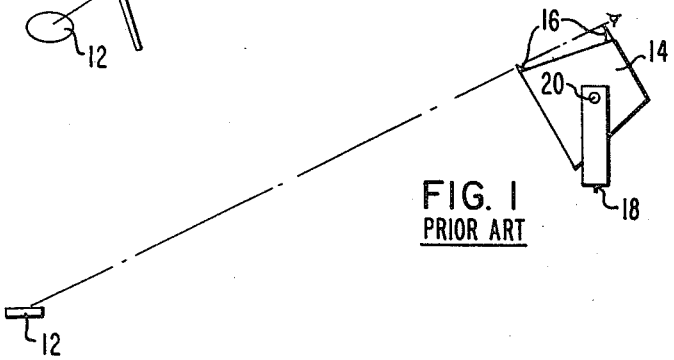
FIG. 1 PRIOR ART
FIG. 1 is a schematic illustration of a prior art method of aiming a flood light.
Figure 3:
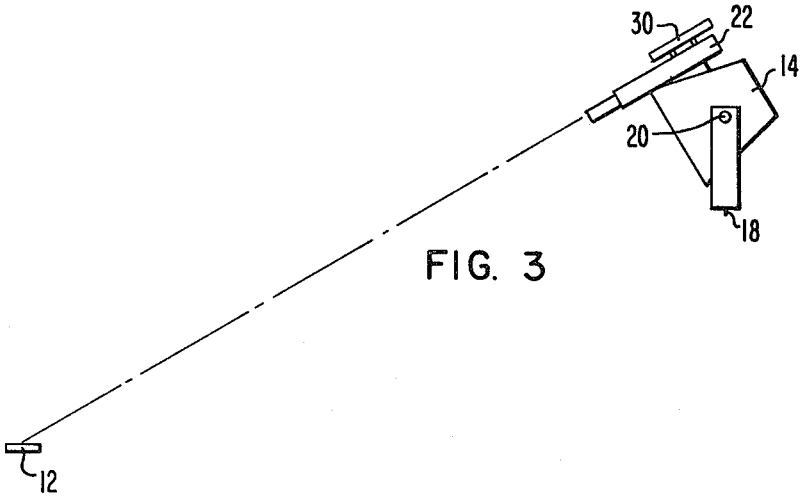
FIG. 3 is a schematic illustration of an alternative method for aiming a flood in accordance with the present invention.

Although these "pie plate" locations could be accurately determined prior to the present invention, the aiming of the flood light at this preselected location was one of essentially trial and error. In the schematic illustration of FIG. 1, a flood light 14 has improvised thereon a site of the "rifle type" employed in an effort to aim the flood light at the "pie plate" location 12. The flood light, with this prior art method, was visually aimed through the rifle type site and the flood light 14 could be directionally adjusted horizontally about a mounting pivot point 18 and a vertical pivot point 20 until the operator felt that the flood light was properly aimed. The flood light was then fixed at this orientation with respect to the mounting pole in a conventional manner. In many instances when the system was finally tested many of the flood lights were found to not be accurately aimed and it was necessary that certain of the flood lights be reaimed in an effort to duplicate the predetermined aiming pattern designed by the engineer or designer. In one embodiment of this invention (FIG.

3), a low powered laser 22 is temporarily mounted to the luminaire with the axis of the collimated radiative output of the laser set parallel to the beam axis of the luminaire. The laser is then activated and aimed at the "pie plate" 12 until it is perceived that the beam impinges on the pie plate. The luminaire is then secured both horizontally and vertically at 18 and 20 in the accurately aimed position.

Figure 2:
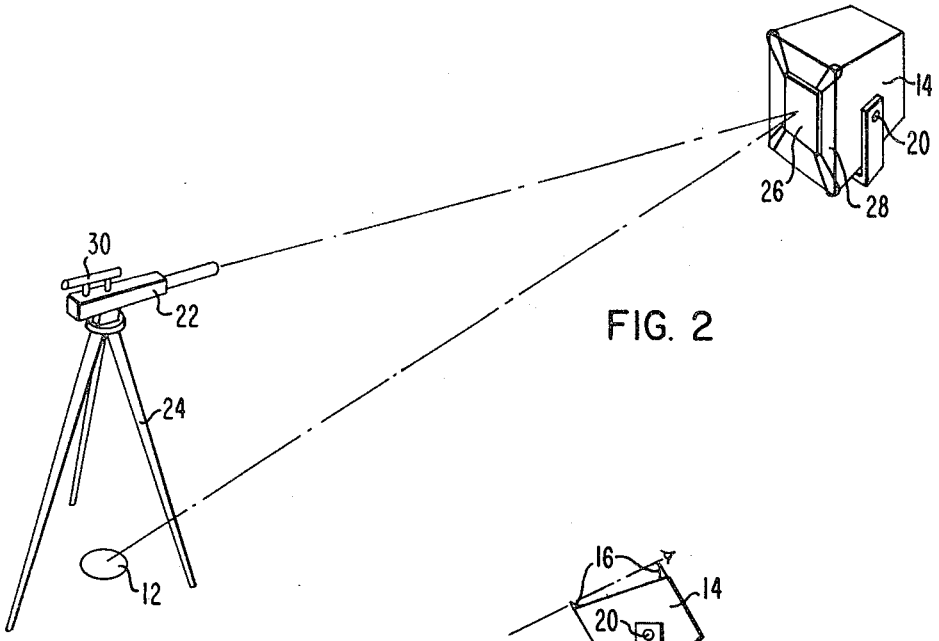
FIG. 2 is a schematic illustration of the preferred method of aiming a flood light in accordance with the present invention.

Some difficulties may be encountered and time consumed in moving a laser from flood light to flood light in a large lighting system and in accordance with preferred embodiment (FIG. 2), the laser 22, mounted on a tripod 24, is positioned directly over the "pie plate" location on the plane surface. The person adjusting the flood light places a mirror over the flood light face, or lens 28 and the laser operator 22 employing a telescopic site 30 mounted to the laser aims the laser at the mirror. The person adjustably aiming the flood light then moves the flood light until the reflected laser beam impinges on the pie plate 12 at which time the flood light is accurately aimed and the aiming position is fixed with respect to the support pole. In practicing the present invention, it is preferred that the mirror 26 be a gold mirror in order to provide a more visable reflected laser beam and the laser 22 is preferably a low power five milliwatt helium neon laser such as for example Model LT-4 Transit-Light manufactured by Spectra Physics Company, Mountain View, Calif.

Although this invention has been described with respect to the aiming of flood lights for a sports facility, it will be readily apparent that the method of this invention can be employed for aiming flood lights for any purpose particularly, where accuracy is important.

What is claimed is:

1. The method of aiming a flood light at a preselected location comprising the steps of:

situating a laser at said preselected location;

directing the collimated radiative output of said laser at a mirror surface on the face of a flood light;

adjustably aiming said flood light to cause said laser output to reflect from said mirror surface back to said preselected location; and fixing said flood light in a position to remain aimed at said preselected location.

2. The method of claim 1 wherein said mirror surface is a gold mirror.

3. The method of claim 1 wherein a target is placed at said predetermined location whereby perception of impingement of said laser output at said predetermined locations is enhanced.

4. The method of claim 1 wherein said laser is a five milliwatt helium neon layer.

5. A method for aiming a flood light at a preselected location comprising the steps of:

placing a reflective mirror over the lens of said flood light;

locating a laser at said preselected location;

directing the collimated radiative output of said laser at said reflective mirror on said flood light lens; and adjusting the direction of said flood light to reflect the directed laser output back to said preselected location.

6. The method of claim 5 wherein said reflective mirror is a gold mirror.

7. The method of claim 5 wherein a target is placed at said preselected location thereby enhancing the perception of impingement of said laser output at said preselected location.

* * * * *